United States Patent [19]

Kaplan et al.

[11] Patent Number: 4,842,716

[45] Date of Patent: Jun. 27, 1989

[54] ETHYLENE FURNACE ANTIFOULANTS

[75] Inventors: Morris Kaplan; John C. Kisalus, both of Houston, Tex.

[73] Assignee: Nalco Chemical Company, Naperville, Ill.

[21] Appl. No.: 84,942

[22] Filed: Aug. 13, 1987

[51] Int. Cl.[4] ..... C10G 9/16

[52] U.S. Cl. ..... 208/48 AA; 208/44; 208/47; 252/389.2; 252/389.21; 252/389.24; 252/389.32; 585/950; 585/648; 585/650; 423/DIG. 8

[58] Field of Search ..... 208/48 AA, 47; 585/950, 585/648, 650; 252/389.2, 389.21, 389.24, 389.32; 423/DIG. 8

[56] References Cited

U.S. PATENT DOCUMENTS

| | | | |
|---|---|---|---|
| 3,189,537 | 6/1965 | Carlton | 208/48 AA |
| 3,483,133 | 12/1969 | Hatch et al. | 208/48 AA |
| 3,558,470 | 1/1971 | Gillespie et al. | 208/48 AA |
| 3,645,886 | 2/1972 | Gillespie et al. | 208/48 AA |
| 3,977,981 | 8/1976 | Dunlop et al. | 252/8.555 |
| 4,024,048 | 5/1977 | Shell et al. | 585/950 |
| 4,024,049 | 5/1977 | Shell et al. | 208/48 AA |
| 4,024,050 | 5/1977 | Shell et al. | 208/48 AA |
| 4,024,051 | 5/1977 | Shell et al. | 208/48 AA |
| 4,105,540 | 8/1978 | Weihland | 208/950 |
| 4,344,861 | 8/1982 | Levy | 208/47 |
| 4,435,361 | 3/1984 | DaGue | 252/8.555 |
| 4,542,253 | 9/1985 | Kaplan et al. | 208/48 AA |
| 4,614,600 | 9/1986 | Braddon | 252/8.555 |

FOREIGN PATENT DOCUMENTS

| | | | |
|---|---|---|---|
| 1205768 | 6/1986 | Canada | 208/48 AA |

*Primary Examiner*—H. M. S. Sneed
*Assistant Examiner*—Helane Myers
*Attorney, Agent, or Firm*—John G. Premo; John S. Roberts, Jr.; Anthony L. Cupoli

[57] ABSTRACT

An improved method for reducing fouling and corrosion of ethylene cracking furnaces using petroleum feedstocks, the improvement comprising treating the petroleum feed stock with at least 10 ppm of a combination of a phosphorous antifoulant compound and a filming inhibitor. The antifoulant compound is chosen from the group consisting of phosphite esters, phosphate esters, thiophosphite esters, thiophosphate esters and mixtures thereof, said esters being characterized by the formulas (1) (2)

where X equals S or O, and $R_1$, $R_2$, and $R_3$, are each independently selected from the group consisting of hydrogen, water soluble amine, alkyl, aryl, alkaryl, cycloalkyl, alkenyl, and aralkyl group provided that in at least one and not more than two of each $R_1$, $R_2$, and $R_3$ are water soluble amines having partition coefficients greater than 1.0 mixed with a filming amount of at least 2–20 ppm imidazoline filming inhibitor prepared preferably from naphthenic or fatty acids and poly amines.

17 Claims, 2 Drawing Sheets

ETHYLENE FURNACE SIMULATION UNIT

ETHYLENE FURNACE SIMULATION UNIT

FURNACE SIMULATION CORROSION STUDY

ETHYLENE FURNACE ANTIFOULANTS

FIELD OF THE INVENTION

This invention relates to an improved method for reducing fouling and corrosion of ethylene cracking furnaces using petroleum feedstocks, the improvement comprising treating the petroleum feed stock with at least 10 ppm of a combination of a phosphorous antifoulant compound and a filming inhibitor. The antifoulant compound is chosen from the group consisting of phosphite esters, phosphate esters, thiophosphite esters, thiophosphate esters and mixtures thereof, said esters being characterized by the formulas

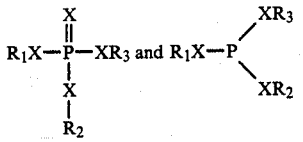

(1) (2)

where X equals S or O, and $R_1$, $R_2$, and $R_3$, are each independently selected from the group consisting of hydrogen, water soluble amine, alkyl, aryl, alkaryl, cycloalkyl, alkenyl, and aralkyl group provided that in at least one and not more than two of each $R_1$, $R_2$, and $R_3$ are water soluble amines having partition coefficients greater than 1.0 mixed with a filming amount of at least 2–20 ppm imidazoline filming inhibitor prepared preferably from naphthenic or fatty acids and poly amines. The filming corrosion inhibitor is chosen from the group of substituted imidazolines such as those defined by one of the following formulas:

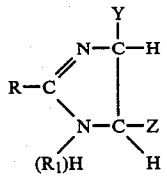

(3)

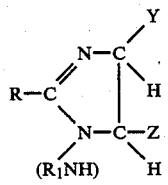

(4)

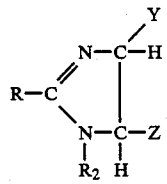

(5)

Where in formulas (3), (4), and (5) above, R is an aliphatic group of from about 1 to 22 carbon atoms in chain length, Y and Z are selected from the group consisting of hydrogen and lower aliphatic hydrocarbon groups of not more than 6 carbon atoms in chain length, $R_1$ is an alkylene radical of about 1 to 6 carbon atoms, $R_2$ is a radical selected from the group consisting of R and hydrogen, and n is an integer of from about 1 to 50.

BACKGROUND OF THE INVENTION

Weinland, U.S. Pat. No. 4,105,540 teaches the use of phosphorus containing compounds as anti-foulants in ethylene cracking furnaces. The Weinland patent describes the use of amine neutralized phosphate and phosphite esters to suppress the formation of coking deposits in ethylene furnaces. It will be noted that U.S. Pat. No. 4,105,540 discloses the use of imidazolines in neutralizing amounts rather than in much lesser quantities of filming imidazolines described and claimed in this specification. However, there is no showing in the patent that these materials have specific anticorrosive properties.

U.S. Pat. No. 4,542,253 (Kaplan et al.) discloses an improved method of reducing the corrosion associated with the use of the antifoulants of the Weinland patent. The improvement uses water soluble amines having partition coefficients greater than 1.0 to neutralize the phosphate and phosphite esters. The examples presented in U.S. Pat. No. 4,542,253 show the improved corrosion protection afforded by the phosphorus compounds neutralized with water soluble amines compared with the same phosphorus compounds neutralized with fatty amines of the Weinland patent.

Experience has now shown that the phosphate and phosphite esters neutralized with water soluble amines when used over prolonged periods of time in ethylene furnaces, while providing antifouling protection, do not provide adequate corrosion protection.

PROCESS OF THE INVENTION

Figure 1:
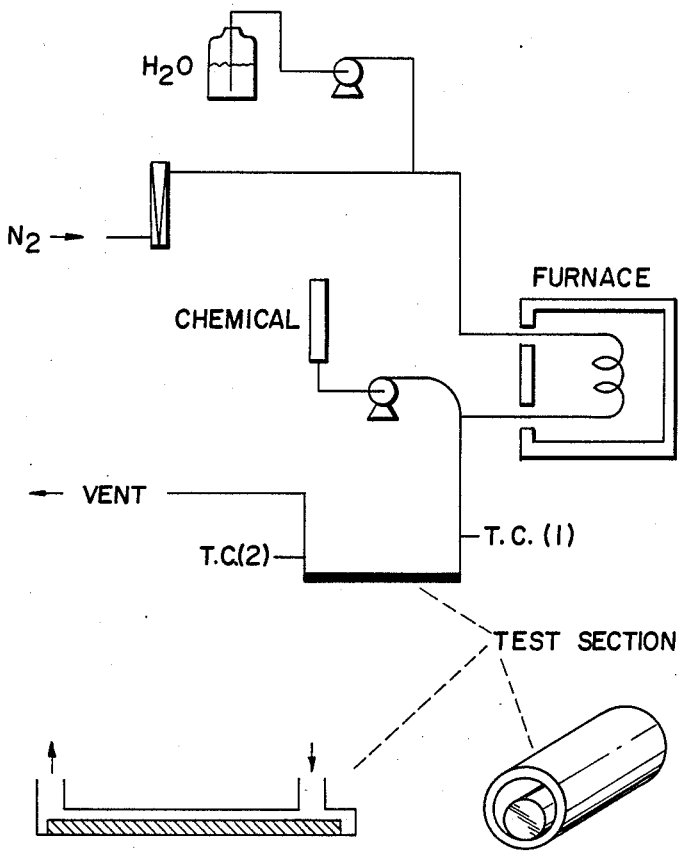
FIG. 1 depicts a laboratory ethylene furnace simulation unit, which is designed to simulate conditions in the convection section of an ethylene furnace.

The present invention is an improved method of reducing fouling and inhibiting corrosion in ethylene cracking furnaces using petroleum feedstocks. The improvement comprises treating the petroleum feedstocks with at least 10 ppm and preferably 25–500 ppm of a mixture of a phosphorus compound and a film forming or filming corrosion inhibitor. The phosphorus compounds comprise the phosphate and phosphite esters neutralized with water soluble amines having partition coefficients greater than 1.0 as described in U.S. Pat. No. 4,542,253. The phosphorus compounds are effective in inhibiting and suppressing the fouling material that deposits and accumulates upon furnace surfaces. The preferred film forming corrosion inhibitors are imidazolines prepared from naphthenic or fatty acids and polyamines. The filming amines are believed to adsorb to the metal surface, possibly in the form of a monolayer, producing a hydrophobic barrier to the corrosive environment. Examples of other filming corrosion inhibitors which may be used are bis-amides resulting from reaction of one mole of amine with one equivalent of a dicarboxylic acid, U.S. Pat. No. 4,344,861; condensate of a polyamine with a 21 or 22 carbon fatty polycarboxylic acid or acid anhydride, U.S. Pat. No. 4,614,600; bis-imidazolines prepared from polyamines and dibasic acids having 8 or more carbon atoms, U.S. Pat. No. 2,646,399.

Corrosion inhibitors fall into several classes: passivators, precipitators, cathodic, anodic, neutralizing and filming (adsorbing). The two types of inhibitors which are relevent to this invention are neutralizers and filmers. Neutralizers are generally volatile nitrogen compounds, such as ammonia, cyclohexylamine and morpholine, and function primarily by neutralizing corrosive organic or inorganic acids. At least one equivalent of neutralizer per equivalent of acid is required to effectively inhibit corrosion using a neutralizing amine. Filming amines, however, are effective at very much smaller dosages. For example, the preferred imidazoline filmer of this invention, when used at a concentration of 25 ppm, will effectively inhibit the corrosion of mild steel in 0.1M hydrochloric acid in the wheel box test, whereas 5,000 ppm of a neutralizer, such as morpholine, is required to achieve the same degree of inhibition under the same test conditions.

Weinland, U.S. Pat. No. 4,105,540 recognized that the unneutralized phosphorus antifoulants, being strongly acidic, should be neutralized to avoid potential corrosion problems, and therefore, formulated the phosphorus compounds with at least one mole of neutralizer per mole of phosphorus. U.S. Pat. No. 4,105,540 discloses the use of imidazolines as neutralizers, but there is no mention of the filming properties of the imidazolines. It is believed that Weinland failed to recognize the potential value of imidazolines as corrosion inhibitors in ethylene unit applications by virtue of their film forming properties rather than their neutralizing properties. Therefore, the commercial product which Weinland developed was a phosphorus compound neutralized with at least one mole of Primene 81-R (see U.S. Pat. No. 4,542,253). There is no mention in the Weinland patent of any film forming mechanism.

U.S. Pat. No. 4,542,253 describes an improved method of reducing corrosion associated with phosphorus-based antifoulants in ethylene cracking furnaces by using certain water soluble amines (neutralizers) having partition coefficients greater than 1.0. This composition, while providing antifoulant protection, did not provide adequate corrosion protection in ethylene furnace applications.

The present invention recognizes that corrosion inhibition in ehtylene cracking furnaces should be effectively accomplished using non volatile film-forming inhibitors. The preferred filmers are imidazolines prepared from naphthenic acids or fatty acids and polyamines. A more detailed description of these compounds is disclosed in U.S. Pat. No. 4,105,540 and the list of imidazolines is incorporated herein by reference. An important advantage of the present invention over the prior art is that the filmer is used in much smaller film forming amounts and not as previously disclosed in neutralizing quantities.

To further illustrate the advantages of the invention, the following are presented by way of Examples.

EXAMPLES

EXAMPLE 1

Laboratory research has resolved the corrosion problem exhibited by the morpholine neutralized phosphate and thiophosphate compounds described in U.S. Pat. No. 4,542,253. This work shows that blends of these phosphorus compounds with imidazoline filmers afford corrosion inhibition of better than 90% when tested in a Laboratory Ethylene Furnace Simulation Test Unit (see FIG. 1).

Previous work revealed that when amine-neutralized phosphate salt solutions were concentrated to dryness, a low residue pH was produced which would be corrosive. A simple approach to minimize the corrosivity problem was to formulate the phosphorus based antifoulants with a non-volatile filming corrosion inhibitor. Corrosion testing was first done using the wheel box to show that filming inhibitors, such as imidazolines, were effective in inhibiting phosphoric acid corrosion.

Additional corrosion testing was performed under dynamic conditions which more closely simulate conditions in the convection section of the furnace using the Ethylene Furnace Simulation Unit to test the corrosivity of new furnace antifoulants (see FIG. 1).

Unit conditions were as follows:

Water (steam) flow rate: 6 ml/min
Nitrogen flow rate: 25 liter/min
Additive flow rate: 0.5 ml/min
Test section inlet temperature: 330°–380° F.
Test section outlet temperature: 220°–240° F.
Run time: 5½ hours The mild steel corrosion coupon was sandblasted and weighed before insertion into the test section. After the run the coupon was cleaned with steel wool and the weight loss determined. Results are shown in Table 1.

The data show that the filming imidazolines dramatically inhibit the corrosivity of the morpholine neutralized phosphate ester antifoulants tested. For example, phosphate B with 9% imidazoline E showed approximately 93% corrosion inhibition compared to Phosphate A without filmer.

EXAMPLE 2

Corrision testing was done to test the corrosivity of the morpholine neutralized thiophosphate ester, Thiophosphate C. The Furnace Simulation Unit conditions were identical to those of Example 1 above. As shown in Table 2, the imidazoline filmers effectively reduced the corrosivity of thiophosphate C.

EXAMPLE 3

Figure 2:
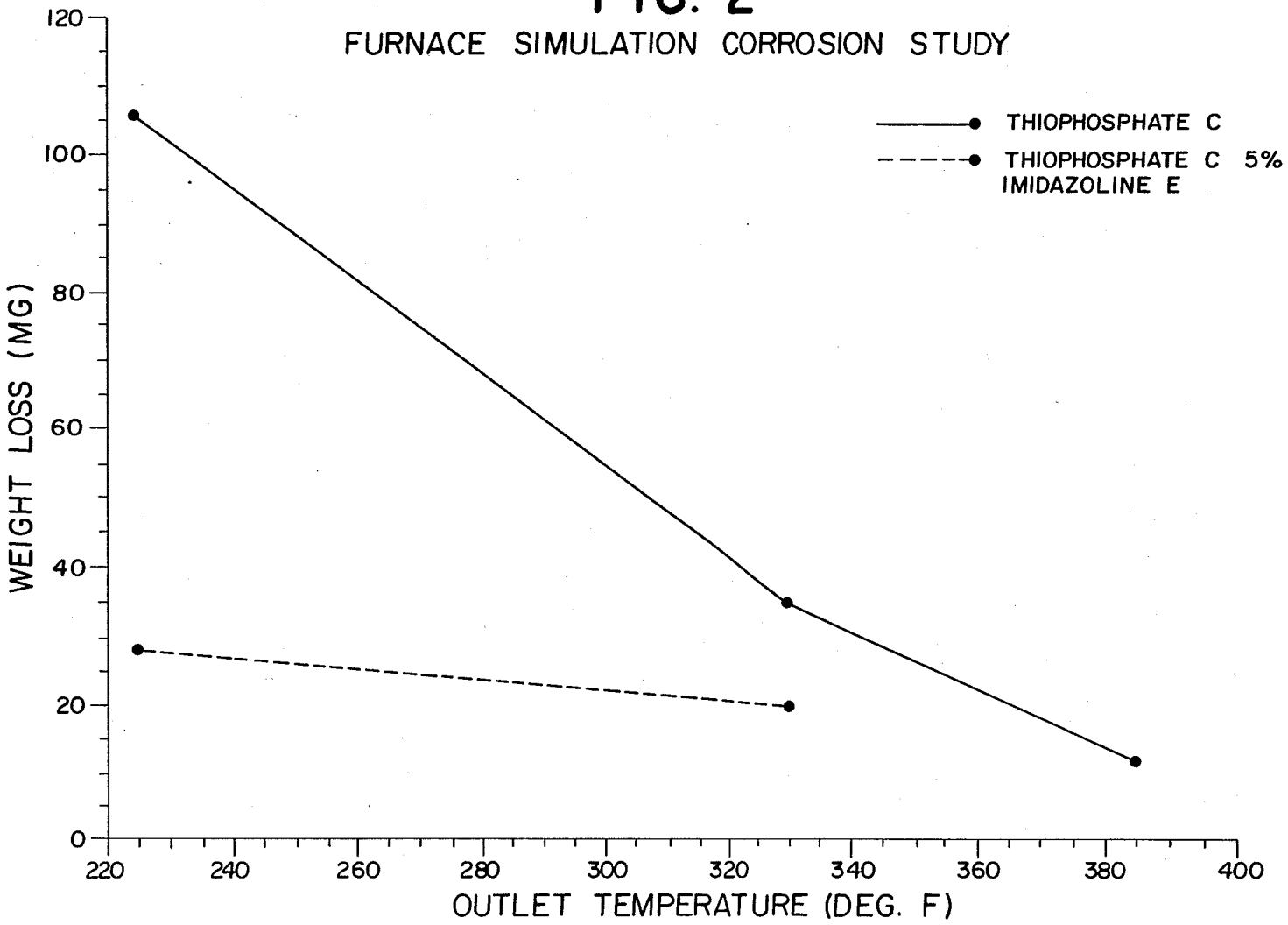
FIG. 2 is a graph showing how corrosivity decreases as the temperature is increased.

Corrosion testing was done using the Ethylene Furnace Simulation Unit to evaluate the corrosivity of thiphosphate C under different temperature conditions. Unit conditions were as follows:

Water (steam) flow rate: 6 ml/min
Nitrogen flow rate: 25 liter/min
Thiophosphate C flow rate: 0.5 ml/min
Test section temperatures: see Table 3
Run time: 5½ hours The results shown in Table 3 and FIG. 2 indicate that corrosivity decreases as the test section temperature is increased, and at outlet temperatures approaching 400° F. corrosion is reduced to a low level with or without the addition of filming inhibitor. At lower temperatures imidazoline E effectively reduces the corrosivity of thiophosphate C.

Specific phosphate and phosphite esters included in the purview of this application are as follows: mono and di isoctylthiophosphate ester; mono and di isoctylphosphate ester; di n-butylphosphite.

Also, specific imidazolines within the purview of this application are: a reaction product of a fatty acid aminoethyl-ethanolamine; a reaction product of a saturated or unsaturated fatty acid with an alkylene polyamine; imidazoline reacted with a hydroxyalkylakylenediamine to form a reaction product;

1-(2 hydroxyethyl)-coco imidazoline;

1-(2 hydroxyethyl)-2 tall oil imidazoline;
1-(2-hydroxyethyl)-2-undecyl imidazoline;
1-(2-hydroxyethyl)-2-tridecyl imidazoline;
1-(2-hydroxyethyl)-2-pentadecyl imidazoline;
1-(2-hydroxyethyl)-2-heptadecyl imidazoline;
1-(2-aminoethyl)-2-heptadecyl imidazoline;
1-(2-aminoethyl)-aminoethyl-1-2-undecyl imidazoline;
1-(2-aminoethyl)-aminoethyl-1-2-tridecyl imidazoline.

TABLE 1

Ethylene Furnace Simulation Unit Corrosion Study

| Additive | Weight Loss (mg) | Average (mg) | % Inhibition* |
|---|---|---|---|
| Phosphate A | 184, 129 | 156.5 | — |
| Phosphate A + 20% Imidazoline D | 28.4, 25.5 | 27.0 | 82.7 |
| Phosphate B | 93, 78.4 | 86.1 | 44.9 |
| Phosphate B + 20% Imidazoline D | 24, 29 | 26.5 | 83.1 |
| Phosphate B + 4.5% Imidazoline E | 26.9 | 26.9 | 82.8 |
| Phosphate B + 9.0% Imidazoline E | 12.7, 9.5 | 11.1 | 92.9 |
| Phosphate B + 13.5% Imidazoline E | 6.0 | 6.0 | 96.2 |

*Relative to Phosphate A
Phosphate A = Morpholine Neutralized isooctyl phosphate ester
Phosphate B = Morpholine neutralized nonylphenol phosphate ester
Imidazoline D = Reaction product of naphthenic acid and diethylene triamine
Imidazoline E = Reaction product of fatty acid and aminoethylethanolamine

TABLE 2

Ethylene Furnace Simulation Unit Corrosion Study

| Additive | Weight Loss (mg) | % Inhibition* |
|---|---|---|
| Phosphate A | 156.5 | — |
| Thiophosphate C | 106 | 32.3 |
| Thiophosphate C + 10% Imidazoline D | 89 | 43.1 |
| Thiophosphate C + 20% Imidazoline D | 42 | 73.1 |
| Thiophosphate C + 9% Imidazoline E | 28.4 | 81.8 |

*Relative to Phosphate A
Thiophosphate C = Morpholine neutralized isooctyl thiophosphate ester
Imidazoline E = Reaction product of naphthenic acid and diethylenetriamine
Imidazoline E = Reaction produce of fatty acid and aminoethylethanolamine

TABLE 3

Furnace Simulation Unit Corrosion Study

| | Test Section Inlet (°F.) | Temperature Outlet (°F.) | Weight Loss (mg) | % Inhibition |
|---|---|---|---|---|
| Thiophosphate C | 350 | 225 | 106 | — |
| Thiophosphate C | 430 | 330 | 35 | 67 |
| Thiophosphate C | 520 | 385 | 12 | 89 |
| Thiophosphate C + 9% Imidazoline E | 350 | 225 | 28 | 74 |
| Thiophosphate C + 9% Imidazoline E | 430 | 330 | 20 | 81 |

We claim:

1. An improvded method for reducing fouling and corrosion of ethylene cracking furnaces using petroleum feedstocks, the improvement comprising treating the petroleum feed stock with at least 10 ppm of a compound selected from one member of the group consisting of phosphite esters, phosphate esters, thiophosphite esters, thiophosphate esters and mixtures thereof, said esters being characterized by the formulas

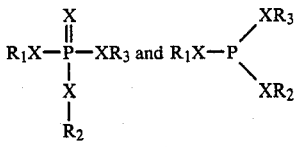

where X equals S or O, and $R_1$, $R_2$, and $R_3$, are each independently selected from the group consisting of hydrogen, water soluble amine, alkyl, aryl, alkaryl, cycloalkyl, alkenyl, and aralkyl group provided that in at least one and not more than two of each $R_1$, $R_2$, and $R_3$ are water soluble amines having partition coefficients greater than 1.0 mixed with a filming quantity of about 2–20 ppm of an imidazoline filming inhibitor prepared from naphthenic or fatty acids and polyamines.

2. The method of claim 1 wherein the ester is a blend of the mono and di isoctylthiophosphate ester.

3. The method of claim 1 wherein the ester is a blend of the mono and di isoctylphosphate ester.

4. The method of claim 1 wherein the ester is di n-butylphosphite.

5. The method of claim 1 wherein the imidazoline filming inhibitor is present in a minor filming quantity sufficient to inhibitor corrosion of about 2–20 ppm.

6. The method of claim 5 wherein the imidazoline filming inhibitor is a reaction product of a fatty acid and aminoethyl-ethanolamine.

7. The method of claim 5 wherein the imidazoline is a reaction product of a saturated or unsaturated fatty acid with an alkylene polyamine.

8. The method of claim 5 wherein the imidazoline is reacted with a hydroxyalkylalkylenediamine to form a reaction product.

9. The method according to claim 1 wherein the imidazoline is 1-(2-hydroxyethyl)-coco imidazoline.

10. The method according to claim 1 wherein the imidazoline is 1-(2-hydroxyethyl)-2 tall oil imidazoline.

11. The method according to claim 1 wherein the imidazoline is 1-(2-hydroxyethyl)-2-undecyl imidazoline.

12. The method according to claim 1 wherein the imidazoline is 1-(2-hydroxyethyl)-2-tridecyl imidazoline.

13. The method according to claim 1 wherein the imidazoline is 1-(2-hydroxyethyl)-2-pentadecyl imidazoline.

14. The method according to claim 1 wherein the imidazoline is 1-(2-hydroxyethyl)-2-heptadecyl imidazoline.

15. The method according to claim 1 wherein the imidazoline is 1-(2-aminoethyl)-2-heptadecyl imidazoline.

16. The method according to claim 1 wherein the imidazoline is 1-(2-aminoethyl)-aminoethyl-1-2-undecyl imidazoline.

17. The method according to claim 1 wherein the imidazoline is 1-(2-aminoethyl)-aminoethyl-1-2-tridecyl imidazoline.

* * * * *